United States Patent [19]

Forster

[11] 4,068,795

[45] Jan. 17, 1978

[54] FOLDED CLOSED CARTON CONVERTIBLE TO OPEN TRAY

[75] Inventor: William Edward Forster, Liverpool, England

[73] Assignee: Metal Box Limited, Reading, England

[21] Appl. No.: 718,985

[22] Filed: Aug. 30, 1976

[51] Int. Cl.[2] ..... B65D 5/24

[52] U.S. Cl. ..... 229/31 R; 206/44 R

[58] Field of Search ..... 229/DIG. 3, 24–26, 229/31 R, 31 FS; 206/44 R, 44 K

[56] References Cited

U.S. PATENT DOCUMENTS

| | | | |
|---|---|---|---|
| 2,249,881 | 7/1941 | Bouchelle | 206/44 K |
| 2,251,565 | 8/1941 | Forman | 229/16 R |
| 2,331,551 | 10/1943 | Guyer | 206/44 K |
| 2,386,062 | 10/1945 | Roehrl | 229/DIG. 3 |
| 2,505,034 | 4/1950 | Fettinger | 206/44 K X |
| 3,154,052 | 10/1964 | Sweeney | 229/31 R X |
| 3,170,618 | 2/1965 | Sweeney | 229/33 |
| 3,348,666 | 10/1967 | McCormick | 206/44 R |

*Primary Examiner*—Robert S. Ward, Jr.

*Attorney, Agent, or Firm*—Diller, Brown, Ramik & Wight

[57] ABSTRACT

For use with frozen food products, such as dough, having a substantially larger bulk volume at an elevated temperature than when frozen, a container is erected from a container blank having a plurality of fold lines and being so arranged that, when the blank is folded along a first selection of said fold lines in a first manner, it defines a container having a bulk capacity of a first predetermined volume and, when folded along a second selection of said fold lines in a second manner, it defines an open, tray-like container having a bulk capacity of a second predetermined volume larger than the said first volume, and a base area different from the base area when the blank is folded in said first manner. The ratio of the said volumes is preferably 1:2. The blank may be glazed or lined (e.g. with aluminum foil) on at least one side thereof.

18 Claims, 4 Drawing Figures

FOLDED CLOSED CARTON CONVERTIBLE TO OPEN TRAY

This invention relates to a container of foldable laminar material, such as cardboard, particularly, though not exclusively, for frozen food products. The invention also relates to blanks for such containers.

According to the invention, in a first aspect thereof, in a primary laminar container blank a plurality of mutually parallel first fold lines and a plurality of second fold lines transverse to the said first fold lines are so arranged that, when the blank is folded along a first selection of said fold lines in a first manner, it defines a container having a bulk capacity of a first predetermined volume and, when folded along a second selection of said fold lines in a second manner, it defines an open, tray-like container having a bulk capacity of a second predetermined volume larger than the said first volume.

By "primary blank" is meant a blank in the substantially flat, unfolded form in which it would normally be punched or cut of a strip or sheet of the laminar material.

According to the invention, in a second aspect thereof, in a secondary blank a first part of a primary blank according to the said first aspect of the invention is folded back on to a second part thereof about a said second fold line and a third part of the said primary blank is likewise folded back on to the said second part thereof about a said second fold line, the said first and third parts being secured to the said second part of the primary blank, the arangement being such that the said second fold lines about which the said first and third parts are folded define edges of the container.

By "secondary blank" is meant a blank in which a said primary blank has been folded, or folded and glued or otherwise processed ready for erection of the container.

According to the invention, in a third aspect thereof, in a container a secondary blank according to the said second aspect of the invention is erected by folding it into a three-dimensional configuration about the said fold lines.

When erected by folding a said secondary blank in the said first manner, the container is preferably closed on all sides and may, for example, be sealable or sealed.

The invention also includes within its scope a container constructed in accordance with the said third aspect of the invention and charged with goods, for example, frozen bulk food products such as dough or frozen products in the form of a plurality of articles such as fish.

One form of container embodying the invention, in the form of a carton intended as packaging for a frozen food product which, depending on ambient or other conditions may occupy different bulk volumes, for example frozen dough, will now be described, by way of example, with reference to the accompanying drawings in which.

Figure 1:
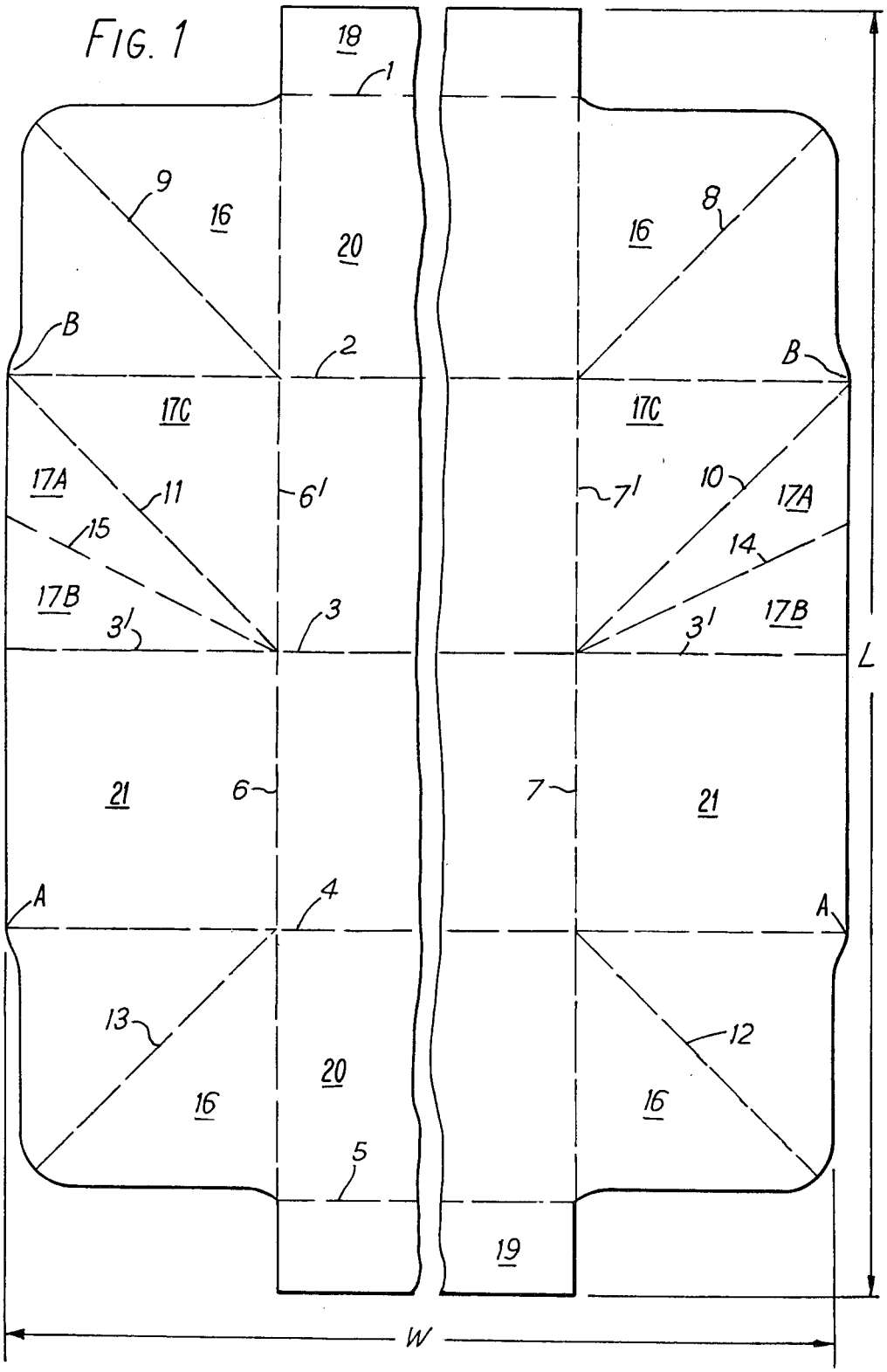
FIG. 1 shows a primary blank for the container.

Referring to FIG. 1, the blank is made of cardboard, glazed and/or printed on one side (viz. the side which is to define the outside of the container or carton) and has a thickness conventional for containers of this kind. Typically the overall length L of the blank is approximately 28 cm and the overall width W 30 cm.

It has a plurality of (in the Example five) mutually parallel and equidistantly spaced first fold lines 1 to 5 and a plurality of second fold lines transverse to the said first fold lines, of which two such second fold lines 6, 7 are perpendicular to the said first fold line, six such second fold lines 8 to 13 are disposed at 45° to the fold lines 1 to 7 and two further fold lines 14, 15 are disposed symmetrically about the longitudinal centre line of the blank at an angle of less than 45° to the first fold line 3.

Figure 3:
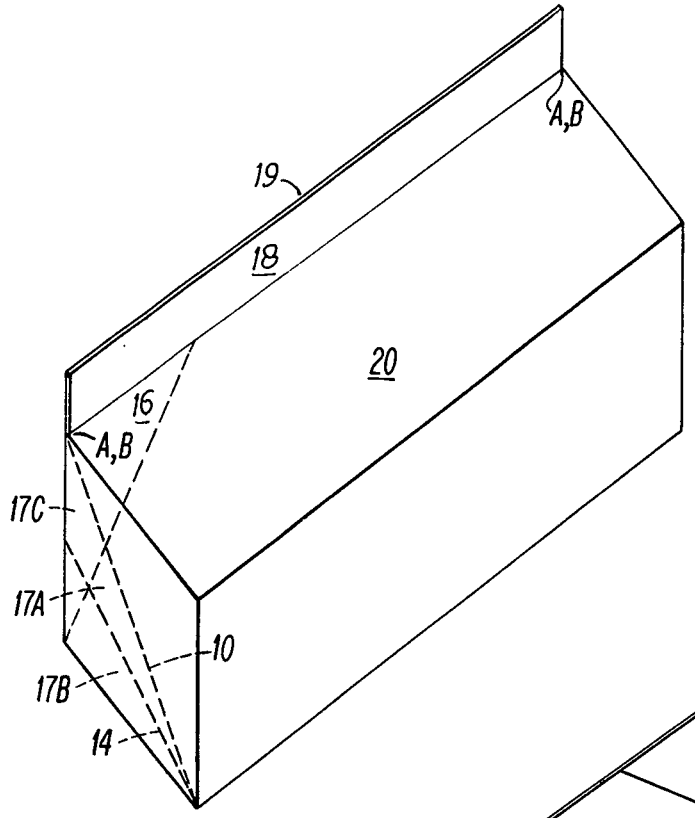
FIG. 3 shows a perspective view of the container erected by folding the secondary blank in the said first manner.

As can be seen in FIG. 3, when the blank is folded along a selection of said fold lines in a particular manner, it defines a closed container having a rectilinear top and base and rectilinear sides and ends.

Figure 4:
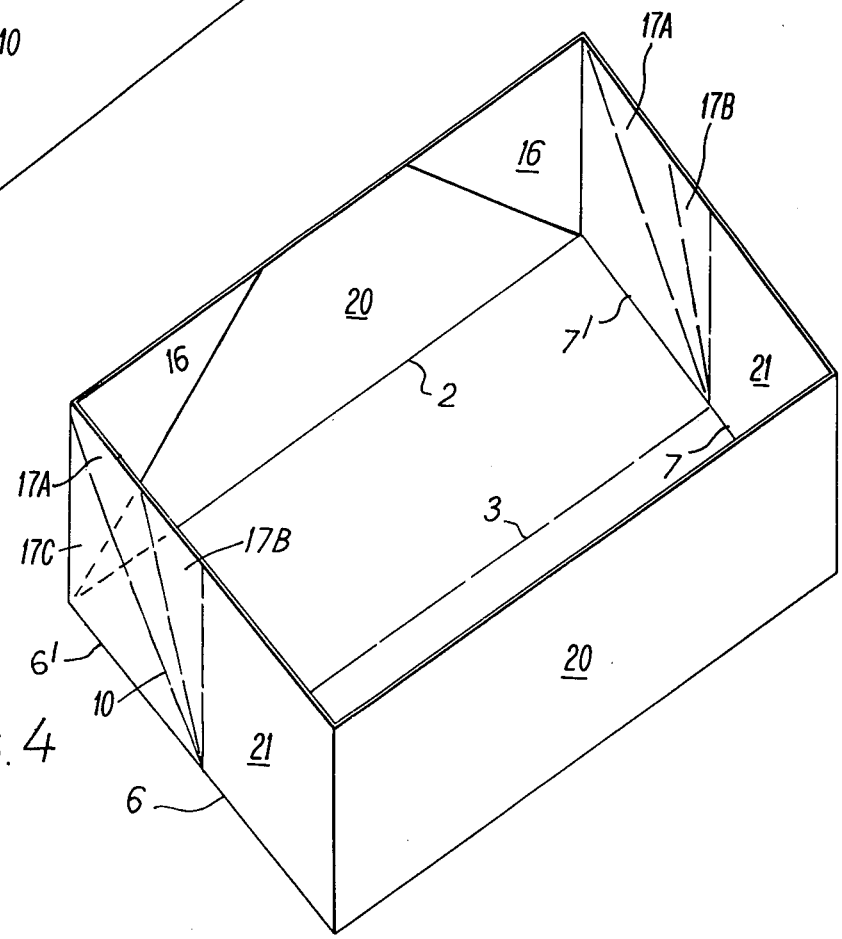
FIG. 4 shows a perspective view of the container erected by folding the secondary blank in the said second manner.

As will be seen from FIG. 4, when the blank is folded along a different selection of said fold lines, i.e. in a different manner, it defines an open, ray-like container having a rectilinear base and rectilinear sides and ends and a bulk capacity of a volume larger than (in the Example twice) that of the carton shown in FIG. 3.

By the fold lines the blank is thus divided up into a plurality of rectilinear panels, such as the rectangular panels 20 and the square panel 21 and also a plurality of triangular or substantially triangular panels such as the substantially triangular panels 16 and the triangular panels 17A and 17B.

In use, the carton is sold to the consumer in a minimum-volume folded-up condition in which it is fully occupied by frozen unrisen dough. In this condition the carton, as shown in FIG. 3, is erected in the said first manner in which the point A is brought on to the point B at each and of the carton, by infolding the two triangular panels, each of which is internally subdivided by the fold line 14 or the fold line 15, as appropriate, to form the panel 17A and the panel 17B; as a whole against the adjacent triangular panels 17C. Portions 3' of the fold line 3 adjacent the panels 17B are then adjacent portions 6' 7' of the fold lines 6, 7 respectively. In addition the triangular panels 16 are caused to be infolded against the adjacent rectangular panels 20. The fold lines 1 and 5 are therefore brought together and the two terminal panels referenced respectively 18 and 19 are brought into face-to-face contact.

The consumer buys the carton with the terminal panels 18, 19 secured together by glueing or the like. For use, he tears off the panels 18, 19 (for which purpose at least one of the fold lines 1, 5 is provided with a configuration (e.g. indentations) to cause it to be weakened). Thereby the carton can be opened out in tray-like form to assume the configuration shown in FIG. 4, by flexing along the central fold line 3. In order to permit this opening-out, the triangular panels 17A, 17B are not secured in any way to the adjacent panels, whereas the panels 16 are secured, e.g. by glueing or corner locks, to the panels 20 at the stage when the secondary blank shown in FIG. 2 is formed.

The carton illustrated has, in the configuration shown in FIG. 4 twice the bulk capacity which it has in the configuration shown in FIG. 3, this ratio being approximately that of the volume of the dough between its risen and unrisen conditions. Thus, when the consumer has opened out the carton into its FIG. 4 configuration and left it in a warm room for a few hours, the dough rises and approximately fills the carton, without spilling out over the carton sides. After the dough has risen, the consumer puts the carton in the oven, and cooks the dough in the normal way. During cooking little or no further rising of the dough occurs.

If the carton is used for other frozen products, e.g. fish, it will be sold, charged with the product concerned, in its tray-like configuration (FIG. 4) and with a suitable top closure. When the consumer has removed the top closure and reduced its contents to less than half, he may convert the carton to its FIG. 3 configuration for the purpose of saving space in a freezer or refrigerator.

Figure 2:
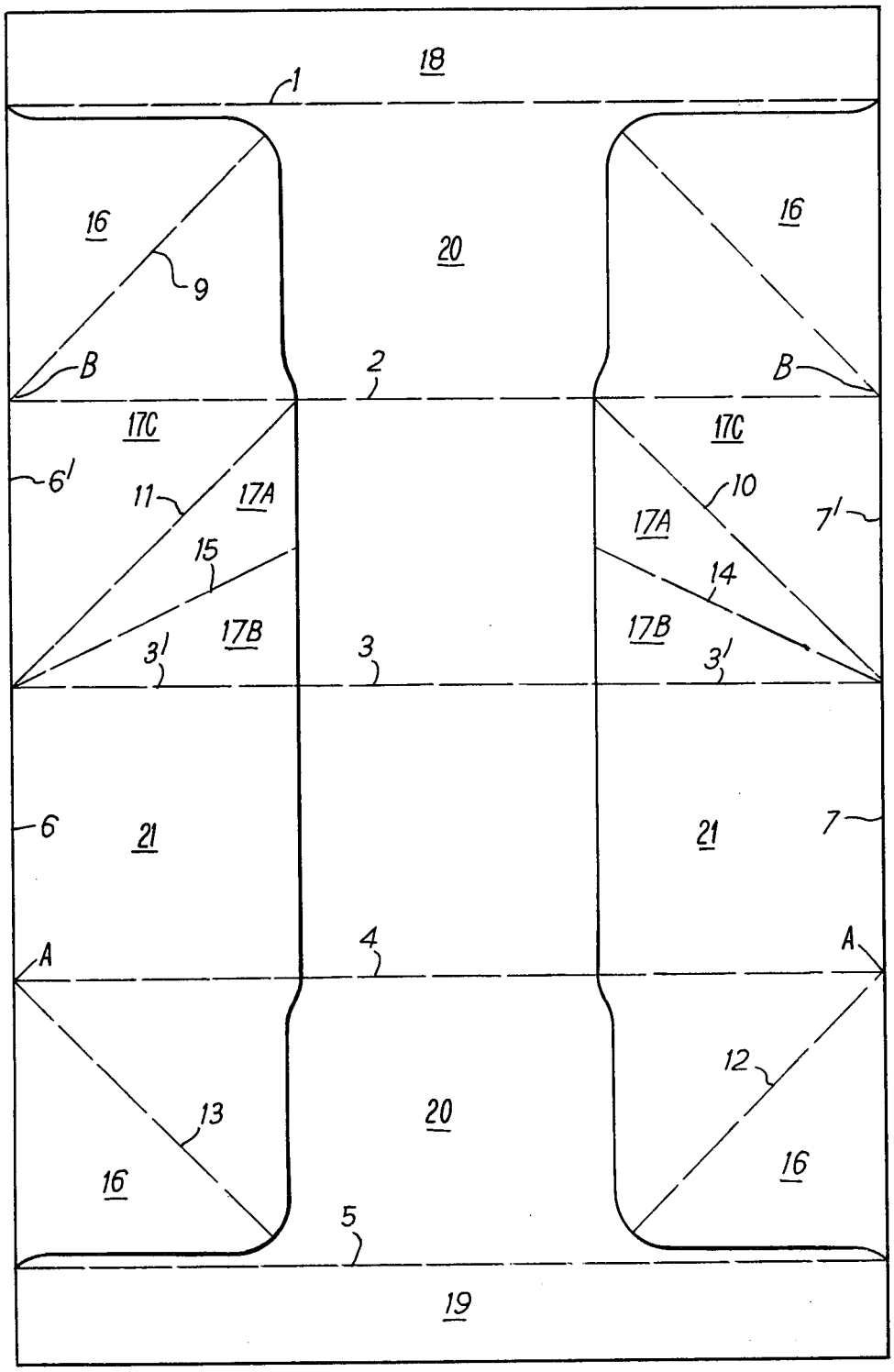
FIG. 2 shows a secondary blank made from the primary blank of FIG. 1.

In a modification of the blank shown in FIGS. 1 and 2, one of the terminal panels 18 or 19 is omitted. In the FIG. 3 configuration of a carton erected from such a modified blank, the remaining terminal panel 18 or 19 is tucked inside the carton and contiguous to the panel 20 which is opposite the said terminal panel 18 or 19, or the carton is made re-closable by means of the said terminal panel in some other way. In the application of the carton to frozen dough as aforesaid, the single terminal panel may be overlapped and glued to the opposing panel 20.

It will be appreciated that the laminar material may be any material suitable for the particular one of the large variety of purposes for which the container embodying the invention may be used. Thus, it need not necessarily be cardboard or it may, for example, be cardboard lined on one and/or the other side (viz. the inside and/or the outside of the container) with a suitable lining material such as polypropylene or metal (e.g. aluminium) foil.

Where a food product intended to be baked in the carton, such as the frozen dough hereinbefore mentioned is intended to be baked in an over whilst in the container at, for example, a temperature of 350° F, it is desirable to provide a said lining of polypropylene or metal (e.g. aluminium) foil for the inside of the continer so as to endow it with "non-stick" properties and, if desired, such a lining may also be provided on the outside of the container, for example in order to render the container more heat resistant and therefore less liable to discolouration or charring when exposed to an excessive oven temperature.

Moreover, if the container is intended to be in the form of a carton charged with a product in the tray-like configuration of the carton for subsequent conversion to its other configuration, as aforesaid, and not intended to be exposed to oven heat, the laminar material may be in the form of cardboard whose surface has not been treated in any way, or its surface may be waxed or otherwise treated or lined with polythene or any other suitable lining material.

I claim:

1. A new article of manufacture comprising a blank for selectively forming an open tray and a closed carton of a size lesser than said tray, said blank being in the form of a generally rectangular sheet, longitudinal fold lines dividing said sheet into a central and two end portions, and transverse fold lines dividing said central portion into body panels and said end portions into edge panels disposed at opposite ends of said body panels, said edge panels of each end portion including two remote connecting panels and only two end panels, one of said two end panels of each end portion having fold line means for positioning said one end panel selectively coplanar with the other of said two end panels and in overlapped relation to the other of said two end panels.

2. The blank of claim 1 wherein each of said connecting panels and said end panels is connected to a respective one of said body panels by a portion of one of said longitudinal fold lines.

3. The blank of claim 1 wherein there are four of said body panels arranged in consecutive order with a first and third being of the same size and a second and fourth of the same size.

4. The blank of claim 3 together with at least one closing panel connected to at least one of said body panels by a further transverse fold line.

5. The blank of claim 2 wherein said end portions are flatly folded into overlying relation to said central portion along said longitudinal fold lines and said connecting panels are permanently additionally secured to respective ones of said body panels.

6. The blank of claim 5 wherein said connecting panels each has fold line means for facilitating folding of each connecting panel upon itself thereby permitting erection of said blank into carton form.

7. The blank of claim 1 wherein said fold line means includes a first diagonal fold line dividing each of said one end panel into halves and a second diagonal fold line dividing one of said halves generally into halves.

8. The blank of claim 7 wherein said diagonal fold lines extend from a common point adjacent the other of said two end panels.

9. The blank of claim 1 wherein the volume of said closed carton is one half the volume of said tray.

10. The blank of claim 3 wherein all of said body panels are of the same size.

11. A closed carton formed from the blank of claim 3 wherein said first body panel is a side panel, said second body panel is a bottom panel, said third body panel is a side panel and said fourth body panel is a top panel.

12. The closed carton of claim 11 wherein there are closure panels extending from said first and fourth body panels, and said closure panels are secured to one another.

13. The closed carton of claim 12 wherein said closure panels are connected to said first and fourth body panels along rupturable lines for effecting opening of said carton to said open tray form.

14. The closed carton of claim 11 wherein said carton is charged with a food product which occupies a greater volume when further treated.

15. The closed carton of claim 14 wherein said food product is dough in an unrisen state.

16. A new article of manufacture comprising a blank for selectively forming an open tray twice as wide as it is deep or a closed elongate carton of square cross-section of half the cross-sectional area of said tray, said blank being in the form of a generally rectangular sheet, first fold lines dividing said sheet into a central portion and two equal width end portions, and second fold lines orthogonal to the first fold lines and dividing said central portion into four body panels of equal width to one another and to said end portions and at least one further panel to connect the two outermost body panels together to form the said closed carton, said second fold lines further dividing said end portions into edge panels disposed at opposite ends of said body panels, said edge panels of each end portion including two remote connecting panels and square end panels which are only two in number and disposed between the connecting panels, one of said two end panels of each end portion having fold line means for positioning said one end panel selectively either coplanar with the other of said two end panels whereby the two end panels together form a side wall of the said open tray and their attached body panels are coplanar to form the tray bottom, or in overlapped relation to the said end panel whereby the said attached body panels form two adjacent body walls of the said closed carton.

17. The blank of claim 16, wherein each of said outermost body panels has a said further panel attached thereto, the two further panels being arranged for mutual attachment in face-to-face relation for closing the carton as a fin extending along one corner of the carton body.

18. The blank of claim 16, wherein each said fold line means comprises a first fold line extending diagonally across the respective said one end panel to form the said one end panel into two mutually hinged triangular parts, and a second fold line particulating that one of said triangular parts which in the closed carton separates the other said triangular part from the said other of the end panels.

* * * * *